US009666056B2

(12) United States Patent
Herrera et al.

(10) Patent No.: US 9,666,056 B2
(45) Date of Patent: May 30, 2017

(54) APPARATUS AND METHOD FOR DETECTING A FIREARM IN A COMMUNICATION SYSTEM

(71) Applicant: MOTOROLA SOLUTIONS, INC, Schaumburg, IL (US)

(72) Inventors: Richard Herrera, Plantation, FL (US); Vernon A Allen, Ft. Lauderdale, FL (US); John B Preston, Plantation, FL (US)

(73) Assignee: MOTOROLA SOLUTIONS, INC., Chicago, IL (US)

( * ) Notice: Subject to any disclaimer, the term of this patent is extended or adjusted under 35 U.S.C. 154(b) by 220 days.

(21) Appl. No.: 14/494,328

(22) Filed: Sep. 23, 2014

(65) Prior Publication Data

US 2016/0086472 A1 Mar. 24, 2016

(51) Int. Cl.

| | |
|---|---|
| ***G08B 1/08*** | (2006.01) |
| ***G08B 21/18*** | (2006.01) |
| ***F41C 33/02*** | (2006.01) |

(52) U.S. Cl.

CPC ..... *G08B 21/18* (2013.01); *F41C 33/029* (2013.01)

(58) Field of Classification Search

None

See application file for complete search history.

(56) References Cited

U.S. PATENT DOCUMENTS 5,479,149 A * 12/1995 Pike ..... F41C 33/0209 340/539.1
5,828,301 A * 10/1998 Sanchez ..... F41C 33/029 224/244
7,158,167 B1 * 1/2007 Yerazunis ..... H04N 5/907 348/61
7,389,604 B2 6/2008 Newkirk et al.

(Continued)

FOREIGN PATENT DOCUMENTS

CA 2751797 A1 4/2012
WO 0113217 A1 2/2001

(Continued)

OTHER PUBLICATIONS

"Embedded Security," BodyComTM Technology, Copyright 1998-2013 Microchip Technology Inc., Retrieved from the Internet URL: http://www.microchip.com/pagehandler/en-us/technology/embeddedsecurity/technology/bodycom.html, retrieved on Oct. 29, 2013, pp. 1-4.

(Continued)

*Primary Examiner* — Julie Lieu
(74) *Attorney, Agent, or Firm* — Barbara R. Doutre

(57) ABSTRACT

A communication system (100) provides a wearable firearm detection system comprising a first body area network (BAN) node (120) coupled to the firearm, a second BAN node (122) coupled to a body wearable apparatus, such as a holster, and a third BAN node (124) coupled to a portable radio (150). The first BAN node detects the presence or absence of the firearm in and out of the holster and com- (Continued)

municates the presence or absence of the firearm to the third BAN node coupled to the radio. In response to the firearm being withdrawn from the holster, the radio can enable one or more actions such as an alert to the user, an alert to a dispatch center (170), or enabling a recording (140) of firearm movement.

20 Claims, 2 Drawing Sheets

(56) References Cited

U.S. PATENT DOCUMENTS

| | | | | |
|---|---|---|---|---|
| 2003/0098774 | A1 | 5/2003 | Chornenky | |
| 2005/0066567 | A1 | 3/2005 | Newkirk et al. | |
| 2006/0092908 | A1 | 5/2006 | Sung et al. | |
| 2006/0098088 | A1 | 5/2006 | Raghunath | |
| 2007/0002815 | A1* | 1/2007 | Ishibashi | G07C 9/00111 370/338 |
| 2007/0190940 | A1 | 8/2007 | Lee et al. | |
| 2008/0061991 | A1* | 3/2008 | Urban | F41C 33/0209 340/573.1 |
| 2008/0204231 | A1* | 8/2008 | Hietanen | F41A 17/063 340/568.1 |
| 2009/0277065 | A1* | 11/2009 | Clark | F41A 19/01 42/1.03 |
| 2012/0088446 | A1 | 4/2012 | Fyke et al. | |
| 2012/0250546 | A1 | 10/2012 | Hamida et al. | |
| 2015/0226505 | A1* | 8/2015 | Amit | F41A 19/01 42/1.02 |
| 2015/0254968 | A1* | 9/2015 | Sanders | F41C 33/029 340/539.13 |
| 2015/0369559 | A1* | 12/2015 | Del Rosario | F41C 33/029 340/686.4 |

FOREIGN PATENT DOCUMENTS

| | | | |
|---|---|---|---|
| WO | 2005/010843 | A1 | 2/2005 |
| WO | 2006/075970 | A1 | 7/2006 |
| WO | 2006/131590 | A1 | 12/2006 |
| WO | 2007066979 | A1 | 6/2007 |

OTHER PUBLICATIONS

International Search Report and Written Opinion for corresponding International Patent Application No. PCT/US2015/048796, mailed on Nov. 12, 2015.

* cited by examiner

APPARATUS AND METHOD FOR DETECTING A FIREARM IN A COMMUNICATION SYSTEM

TECHNICAL FIELD

The present application relates generally to communication systems and more particularly to an apparatus and method for detecting a firearm in a communication system.

BACKGROUND

Public safety personnel often utilize portable battery operated radios as a means of communication. Additionally, such personnel often carry a firearm, and the ability to monitor the firearm may be considered desirable for certain applications or environments. The ability to detect movement of the firearm carried by an individual presents challenges in terms of ease of use, weight and useful monitoring capability in a portable environment. For example, analog based metal detection electronics require the use of large coils, reed switches, and/or components which take up a tremendous amount of real estate, and as such are not appropriate for portable environments. Sensor related approaches tend to be limited to small proximity ranges (typically a few mm), which could lead to false detection, making them unsuitable for certain environments. Wired systems may impose constraints on an individual's ability to move freely. Hall Effect sensors would require placing a magnet in the firearm which might lead to false readings. Electronic metal detection sensors could react to ferrous material or powerful magnets that come in close proximity to the firearm.

Therefore, a non-cumbersome and practical approach is needed for the detection of a firearm in a portable radio environment.

Accordingly, there it would be desirable to provide detection of a firearm as part of a portable communication system.

BRIEF DESCRIPTION OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
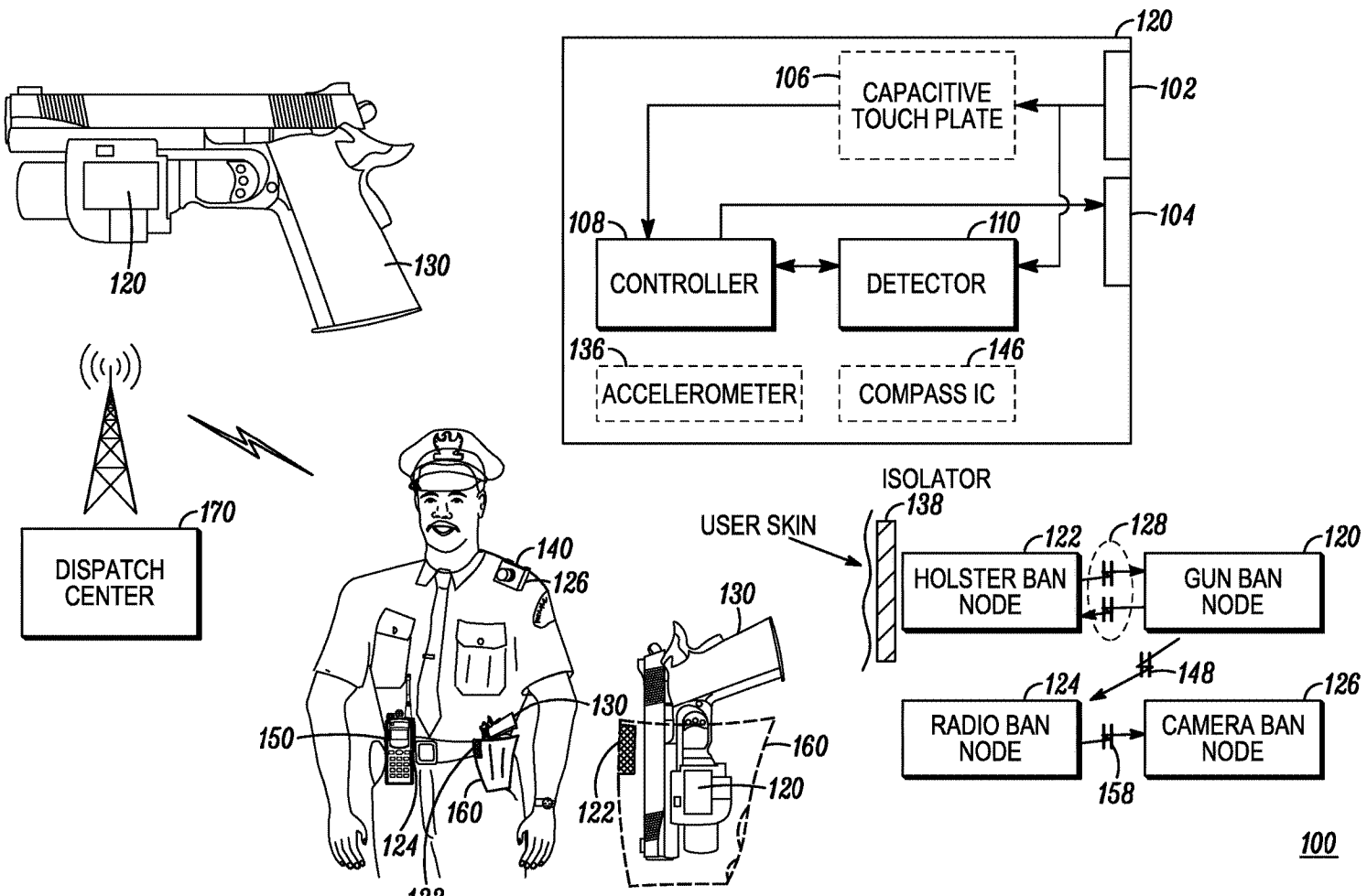
FIG. 1 is a communication system for detecting a firearm in accordance with the various embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of the embodiments of shown.

The apparatus and method components have been represented where appropriate by conventional symbols in the drawings, showing only those specific details that are pertinent to understanding the embodiments shown so as not to obscure the disclosure with details that will be readily apparent to those of ordinary skill in the art having the benefit of the description herein. Other elements, such as those known to one of skill in the art, may thus be present.

DETAILED DESCRIPTION

Before describing in detail embodiments of the invention, it should be observed that such embodiments reside primarily in combinations of apparatus components and method steps related to firearm detection system, and further the incorporation of the firearm detection system as part of a portable, wearable communication system.

FIG. 1 is a communication system 100 for detecting a firearm in accordance with the various embodiments. Communication system 100 provides a wearable firearm detection system, comprising a plurality of BAN nodes shown as a first body area network (BAN) node 120 coupled to a firearm 130, a second BAN node 122 coupled to a body wearable apparatus, and a third BAN node 124 coupled to a portable radio 150. Body area network (BAN) nodes, such as nodes 120, 122, 124, 126 are wearable electronic computing devices that are used to provide network communications among electronic subsystems (sensors, computers, radios etc) worn by a human. Body area network nodes can communicate with each other over a physical layer that may consist of air (radio waves), direct wiring, human skin (capacitive coupled communications) or all of the above. For the purposes of this application, a novel communication system 100 takes advantage of the capacitive coupling available from these nodes.

Portable radio 150 comprises receiver, transmitter and controller (not shown) operating in a public safety environment, such as law enforcement, security or the like. The coupling of the BAN nodes to their respective devices can be achieved by a variety of mounting, attachment or integration means. The body wearable apparatus 160 may comprise a holster, gun belt or other similar body wearable firearm carrying housing. For the purposes of description, the body wearable apparatus 160 may interchangeably be referred to as a holster and the firearm may be referred to as a gun.

In accordance with the various embodiments, the first and second BAN nodes 120, 122 provide detection of a presence or absence of the firearm 130 in and out of the body wearable apparatus 160. When the firearm 130 is withdrawn from the body wearable apparatus 160, the second BAN node coupled to the gun communicates the absence of the firearm to the third BAN node 124 coupled to the radio 150, capacitively coupled over the user's skin. The third BAN node 124 of the portable radio 150 may trigger another local device within the system 100 having a fourth BAN node 126, such as a wearable camera 140 or other electronic device. The portable radio 150 can also communicate information acquired from the third BAN node 124 to a remote location, such as dispatch center 170. Additional embodiments of the communication system 100 also provide for the detection of gunshots and movement of the firearm once removed from the body wearable apparatus 160.

The plurality of BAN nodes of communication system 100 are wireless devices which communicate with each other over using capacitive coupling, represented by capacitive coupling 128 (gun BAN node to holster BAN node), capacitive coupling 148 (gun BAN node to radio BAN node) and capacitive coupling 158 (radio BAN node to camera BAN node). Communication system 100 comprises at least three BAN nodes 120, 122, 124 which have the ability to receive and transmit information, such as asynchronous data packets, to each other via the capacitive coupling between devices. Capacitive coupling is made possible through close proximity to the human skin (the user) or is also possible between materials with sufficient permittivity that allows transmission, such as metal or some plastics. Further control is provided through the use of an isolator 138 to selectively prevent capacitive coupling between some of the nodes.

In order for the plurality of BAN nodes 120, 122, 124 to communicate with each other, the nodes are placed within a predetermined distance of the connecting physical medium. The physical medium comprises a material that can transmit the capacitively coupled signal, such as over the user's skin, metal and/or some plastics. This distance varies from material to material and the range of this connecting distance can be increased or decreased by adjusting the power output of each node.

Each BAN node 120, 122, 124, 126 comprises a receiver input 102 and a transmitter output 104, a controller 108, and a detector 110. The detector 110 is coupled to the receiver input 102. The BAN nodes provide capacitive sensing capability through detector 108 and controller 110. For some embodiments, the gun BAN node 120 may further comprise a capacitor touch plate 106 which operates by receiving and generating capacitive sense information in response to the gun 130 being touched. All capacitive sense information (touch or otherwise) is input to the controller 108 which is operatively coupled to the detector 110. The output 104 of each BAN node generates signals which are capacitively picked up by the other BAN input nodes within the system 100. In accordance with the various embodiments, the capacitive isolator 138 prevents capacitive coupling between the gun BAN node 120 and the holster BAN node 122 when the gun has been pulled out of the holster.

When the gun 130 is in the holster 160, the gun BAN node 120 capacitively couples to the holster BAN node 122 which in turn enables periodic loop communications to occur between the two nodes. These periodic loop communications can be triggered in response to a user touching the gun while the gun is in the holster (in embodiments having the capacitive sense plate 106). Alternatively, these periodic loop communications can be active all the time (in embodiments having no capacitive sense plate).

When the gun 130 is withdrawn from the holster 160, the communications loop between the holster BAN node 122 and the gun BAN node 120 is interrupted. Capacitive coupling 148 then occurs between the gun BAN node 120 and the radio BAN node 124 over the user's skin. The capacitive isolator 138 prevents capacitive coupling between the gun BAN node 120 and the holster BAN node 122 when the gun is withdrawn from the holster 160. The capacitive isolator 138 material comprises a predetermined permitivity sufficiently low for capacitively isolating the second BAN node (the holster node) from the user's skin. Alternatively, the holster 160 may be made of a material which sufficiently isolates the second BAN node 122 (the holster BAN node) from the user's skin. The capacitive isolator 138 may be coupled to the holster 160 or may be integrated as part of the holster.

If other devices are present within the wearable system 100, the radio BAN node 124 capacitively couples 158 over the user's skin to those devices, such as to the camera BAN node 126. The radio BAN node 124 can enable the other nodes to perform predetermined function. For example, the camera 140 can be enabled by the camera BAN node 126 to record images in response to the detection that the gun 130 has been withdrawn from the holster 160.

In embodiments in which the gun BAN node 120 includes the touch sense plate 106, the first, second and third BAN nodes 120, 122, 124 can be maintained in a sleep mode when not activated. When the user grabs the gun handle to pull the gun 130 out of the holster 160, the capacitive touch sense plate 106 in gun BAN node 120 is activated via the gun 130 since it is physically coupled to the gun. The event of activating the touch sense plate 106 wakes up the controller 108 in the first BAN node 120, and the first BAN node 120 of the gun begins sending periodic loop communications through the capacitively coupling 128 to the second BAN node 122 of the holster. When the gun is pulled out of the holster 160, the isolator 138 breaks a path that would otherwise be there from the gun BAN node 120 to holster BAN node 122 over the user's skin (for example from gun BAN node 120 to the user's hand to arm to torso to side of hip back into holster BAN node 122). Also, when the user's hand comes into contact with the gun 130, a capacitively coupled physical layer connection between the first BAN node 120 (gun BAN node) the third BAN node 124 (radio BAN node) is formed (capacitive coupling 158) over the user's skin.

When the user pulls the gun 130 out of the holster 160, communication between first and second BAN nodes 120, 122 is interrupted since the physical layer connection between the first and second BAN nodes 120, 122 is interrupted. This interruption triggers the first BAN node 120 (gun BAN node) to send an alert to the third BAN node 124 (radio BAN node) via capacitive coupling 148 over the skin indicating the gun has been withdrawn (a gun withdrawn alert). The alert signal can then be relayed to other BAN nodes of the system 100, such as a fourth BAN node 126 on the camera 140. The alert signal can trigger the camera 140 to being recording. The alert signal can also trigger the portable radio 150 to transmit, via a radio frequency (RF) signal, an alert to a remote location, such as a dispatch center 170. The dispatch center 170 is thus made aware that an officer has withdrawn the gun from the holster.

The capacitor touch plate 106 is advantageous for systems seeking to minimize battery power drain so that the BAN nodes can remain in sleep mode until an event (gun withdrawn from holster) triggers them to wake up. The capacitive touch plate 106 would not be needed in a system where battery life is not critical. In such a system, the first BAN node 120 would be kept activated/on all the time, sending loop around periodic signals (loop around communication) to the second BAN node 122 to verify that they are still connected and thus that the gun 130 is physically in the holster 160. In this alternative embodiment, when the gun is pulled, the loop around communications between the two nodes 120, 122 is interrupted, followed by the first BAN node 120 relaying an alert signal to the third BAN node 124 indicating that the gun has been withdrawn from holster 160.

In both embodiments (touch plate in gun BAN node 120/no touch plate in gun BAN node 120), the loop communications are used between the gun BAN node 120 and the holster BAN node 122. The isolator 138 is also used in both of these embodiments to prevent capacitive coupling between the holster BAN node 122 and the gun BAN node 120 when the gun is withdrawn from the holster. The isolator 138 coupled to the holster 160 enables the gun BAN node to detect a break in the loop around communications.

In a further embodiment, an accelerometer 136 may be installed in the first BAN node 120 to communicate to the other BAN nodes in the system as to how many gunshots were fired. The accelerometer detects the kickback from the gun as indicative of gunshots and the first BAN node 120 communicates this event to other BAN nodes.

In a further embodiment, a compass integrated circuit (IC) 146 may be installed in the first BAN node 120. The addition of the compass IC 146 allows the orientation of the gun 130 to be monitored once removed from the holster 160.

The directional movement of the gun at the first BAN node 120, indicative of gunshots, detected by accelerometer 136 and/or the monitoring of gun orientation, by Compass IC 146, can be relayed to the portable radio BAN node 150. The portable radio 150 can in turn transmit an RF signal to dispatcher 170 providing an automatic notification of the events: gun withdrawn, shots fired, and gun orientation. For systems having additional nodes, such as the camera 126, the events can be recorded as well.

The communication range between the plurality of BAN nodes may be adjustable via the transmitter power at output 104 in each BAN node. Thus, the system 100 provides a wireless, non-cumbersome approach to firearm detection in a wireless manner. The wearable firearm detection system can be configured to trigger on predetermined events, such as the detection from the first, second or third BAN nodes that the firearm has been withdrawn from the user wearable apparatus and/or shots have been fired and/or that the directional movement and orientation of the gun is changing. Thus, a combination of events can be used in addition to the gun withdrawn-only event.

Figure 2:
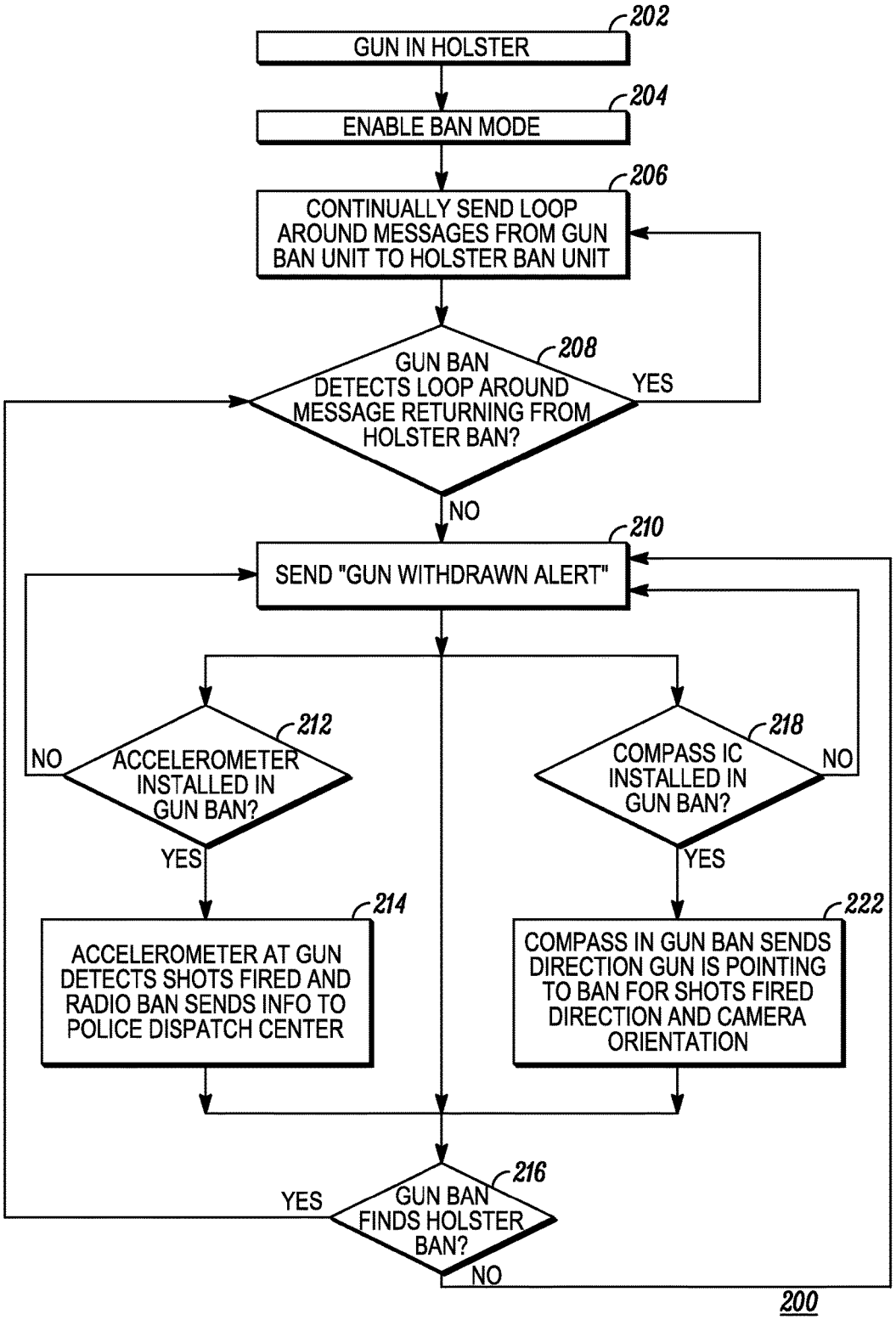
FIG. 2 shows a method of detecting and monitoring a firearm in a communication system in accordance with the various embodiments.

FIG. 2 shows a method 200 of detecting gun location in accordance with the various embodiments. For this embodiment, the nodes will be referred to as radio BAN node, holster BAN node and gun BAN node. Beginning at 202, placement of a gun (having the gun BAN node) into the holster (having the holster BAN node) enables BAN communication at 204 between the two nodes. Periodic loop around messages are continually sent between the gun BAN node and the holster BAN node at 206. At 208, the gun BAN node detects the presence or absence of the loop around message returning from the holster BAN node. If the communications are present (yes), then the method returns to 206 and the gun is deemed to still be in the holster. When the gun is pulled out of the holster, the interruption in communications is detected at 208 by the gun BAN node. The interruption in communications is controlled by isolating the holster BAN node with a capacitive isolator which prevents capacitive coupling from the gun over the skin (hand to arm to torso to waist) to the holster. In response to the gun BAN node detecting a break the communications loop at 208, the gun BAN node sends a "gun withdrawn alert" to the radio BAN node 124. This alert is sent over the user's skin.

In response to the gun withdrawn alert signal at 210, the radio can enable one or more of a plurality of actions in accordance with the various embodiments. The radio can alert the user or surrounding individuals that the gun has been withdrawn; the radio can alert a remote location center that the gun has been withdrawn; the radio can alert another local BAN node to begin to take action. Such embodiments are described next.

In the alert embodiment, the radio generates an alert signal indicating that the gun has been withdrawn from the holster at 210. Such a signal may be an audio signal and/or an automated transmit signal back to a dispatch center. As an example, when an officer pulls his/her gun from the holster, there may not be sufficient time to notify dispatch. The automated alert signal sent back to dispatch provides an extra level of protection, such as to send backup. As a further example, if an officer is down and the gun is withdrawn from the holster without the officer's knowledge, an audible alert will make surrounding individuals aware of the situation. The alerts can continue until the gun has been inserted back into the holster causing the continuous communications loops between the gun BAN node and the holster BAN node to regenerate at 216. The method 200 can then return back to having the gun BAN node monitor for the presence or absence of the loop communications at 208.

As described previously, the wearable gun detection system can be configured to trigger on predetermined events, such as the detection that the gun has been withdrawn from the holster, the gun orientation and/or shots being fired. Thus, a combination of events can be in addition to a gun withdrawn-only event, if desired.

For example, the method 200 can check for an accelerometer being coupled to the gun BAN node at 212, and if so the accelerometer can further detect gunshots (based on movement of the gun) at 214. This gunshot movement of the gun is detected by the gun BAN node which communicates the gunshot movement signal to the radio BAN node. The radio BAN node then alerts the portable radio, and the portable radio automatically alerts, via an RF signal to the dispatch centre that shots have been fired at 214.

The method 200 can also be enhanced through the use of a compass IC installed at the gun. Upon withdrawal of the gun from the holster, the compass IC can be detected by the gun BAN node at 218. When the compass IC is detected at 218, then the direction of gun movement, orientation and position is monitored at 222. The gun BAN node communicates the gun position to the portable radio BAN node, which in turn can communicate, for example, with a BAN node of a portable camera. Images of the gun movement direction and orientation can thus be recorded by the body worn camera, sent to the radio and then transmitted to the dispatch centre by the radio.

The method 200 can continue sending alerts at 210 until the gun has been placed back into the holster at 216. When the gun is re-inserted back into the holster as detected at 216, the gun BAN node and the holster BAN node will re-start the continuous loop communications at 206 and continue monitoring for interruptions at 208.

Thus, the method and system can operate to detect gun-withdrawn events and gun withdrawn in conjunction with other predetermined events, such as orientation and gunshots.

Method 200 can also be adjusted as previously described in conjunction with FIG. 1 to optimize battery life through the addition of a capacitive touch plate to the gun BAN node. To optimize battery life, the nodes may remain in a sleep mode and the sensing of the user's hand on the gun at the gun BAN node would enable the communication loop between the gun BAN node and the holster BAN node, prior to withdrawal of the gun from the holster. In this embodiment, the communication loop is only enabled when the hand is placed on the gun as opposed to having the gun and holster BAN nodes being continually active. Both embodiments still advantageously allow for the determination of gun withdrawn and the further embodiments of gunshot detection and monitoring of gun orientation.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure and Summary section are provided to allow the reader to quickly ascertain the nature of the technical disclosure. It is submitted with the understanding that neither will be used to interpret or limit the scope or meaning of the claims. In addition, in the foregoing Detailed Description, it can be seen that various features are grouped together in some embodiments for the purpose of streamlining the disclosure. This method of disclosure is not to be interpreted as reflecting an intention that the embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

Those skilled in the art will recognize that a wide variety of modifications, alterations, and combinations can be made with respect to the above described embodiments without departing from the spirit and scope of the invention and that such modifications, alterations, and combinations are to be viewed as being within the scope of the inventive concept. Thus, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims issuing from this application. The invention is defined solely by any claims issuing from this application and all equivalents of those issued claims.

The invention claimed is:

1. A wearable firearm detection system, comprising:

a first body area network (BAN) node coupled to a firearm;

a second BAN node coupled to a body wearable apparatus;

a third BAN node coupled to a portable radio;

the first BAN node detecting a presence or absence of the firearm in and out of the body wearable apparatus, and the first BAN node communicating the presence or absence of the firearm to the third BAN node coupled to the portable radio; and a capacitive isolator having predetermined permittivity sufficiently low for capacitively isolating the second BAN node from a user's skin.

2. The wearable firearm detection system of claim 1, further comprising:

a capacitive isolator coupled to a holster.

3. The wearable firearm detection system of claim 1, further comprising:

a holster comprising a capacitive isolator integrated therein.

4. A wearable firearm detection system, comprising:

a first body area network (BAN) node coupled to a firearm;

a second BAN node coupled to a body wearable apparatus;

a third BAN node coupled to a portable radio;

the first BAN node detecting a presence or absence of the firearm in and out of the body wearable apparatus, and the first BAN node communicating the presence or absence of the firearm to the third BAN node coupled to the portable radio; wherein the first BAN node further comprises a capacitive touch plate; and wherein the first, second and third BAN nodes are in sleep mode while the firearm is in the body wearable apparatus, and the first BAN node enters into a periodic communications loop with the second BAN node in response to activation of the capacitive touch plate; and wherein withdrawal of the firearm interrupts the periodic loop communications and causes the first BAN node to send an alert to the third BAN node.

5. The wearable firearm detection system of claim 1, wherein the body wearable apparatus comprises a holster or a gun belt.

6. The wearable firearm detection system of claim 1, further comprising:

an accelerometer coupled to the first BAN node for detecting gunshots when the firearm is held outside of the holster.

7. The wearable firearm detection system of claim 1, further comprising:

a compass integrated circuit (IC) coupled to the first BAN node for detecting orientation of the firearm when the firearm is held outside of the holster.

8. The wearable firearm detection system of claim 1, further comprising a fourth BAN node coupled to a shoulder mounted camera, wherein the shoulder mounted camera automatically records in response to the gun being withdrawn from the body wearable apparatus.

9. The wearable firearm detection system of claim 1, wherein the portable radio communicates information acquired from the first BAN node to a dispatch center.

10. A wearable firearm detection system, comprising:

a first body area network (BAN) node coupled to a firearm;

a second BAN node coupled to a body wearable apparatus;

a third BAN node coupled to a portable radio;

the first BAN node detecting a presence or absence of the firearm in and out of the body wearable apparatus, and the first BAN node communicating the presence or absence of the firearm to the third BAN node coupled to the portable radio; and wherein the first and second BAN nodes communicate via periodic loop communications when the firearm is in the body wearable apparatus, the periodic loop communications being interrupted when the firearm is withdrawn from the body wearable apparatus, the communications being interrupted by the isolator thereby preventing coupling from the first BAN node to the second BAN node when the firearm is withdrawn from the body wearable apparatus.

11. A communication system, comprising:

a portable radio;

a radio body area network (BAN) node coupled to the portable radio:

a holster for carrying a firearm, the firearm having a firearm BAN node coupled thereto;

a holster BAN node coupled to the holster; and the firearm BAN node for detecting withdrawal of the firearm from the holster and capacitively coupling an alert to the radio BAN node indicating withdrawal of the firearm from the holster; and a capacitive isolator coupled to the holster for isolating the holster BAN node from a wearer of the holster, wherein the capacitive isolator has predetermined permittivity sufficiently low for capacitively isolating the holster BAN node from a user's skin.

12. The communication system of claim 11, wherein the portable radio generates a signal indicating withdrawal of the firearm from the holster in response to the alert from the radio BAN node.

13. The communication system of claim 11, further comprising:

a dispatch center for receiving the signal from the portable radio indicating withdrawal of the firearm from the holster.

14. The communication system of claim 11, further comprising:

a body worn camera having a camera BAN node, the camera BAN node being capacitively coupled to the firearm BAN node when the firearm is withdrawn from the holster, the camera recording movement of the withdrawn firearm in response to the alert from the firearm BAN node.

15. The communication system of claim 11, further comprising:

a compass integrated circuit (IC) coupled to the firearm BAN node for detecting orientation of the firearm when the firearm is held outside of the holster; and an accelerometer coupled to the firearm BAN node for detecting gunshots when the firearm is held outside of the holster.

16. A method of detecting a gun in a communication system, comprising:

monitoring, by a gun body area network (BAN) node, communications between the gun BAN node and a holster BAN node;

interrupting the communications between the gun BAN node and a holster BAN node when a gun is withdrawn from a body worn holster, the communications being interrupted by an isolator that prevents coupling from the gun BAN node to the holster BAN node when a gun is withdrawn from the body worn holster;

detecting, by the gun BAN node, that the communications have been interrupted; and generating an alert signal by the gun BAN node to a radio BAN node indicating that a gun has been withdrawn from the body worn holster.

17. The method of claim 16, wherein the alert signal enables one or more of:

alerting, by a portable radio, a dispatch center of the withdrawn gun;

generating an audible signal indicating the withdrawn gun;

recording images of the gun; and detecting gunshots from the gun.

18. The method of claim 16, further comprising, after the step of monitoring:

interrupting the communications by withdrawing a gun from a holster.

19. The method of claim 16, further comprising, after the step of monitoring:

isolating the communications from the gun BAN node to the holster BAN node through a capacitive isolator.

20. The method of claim 16, wherein the gun BAN node is coupled to a gun, the holster BAN node is coupled to a body worn holster, and the radio BAN node is coupled to a portable radio.

* * * * *